US005244090A

United States Patent [19]

Keith

[11] Patent Number: 5,244,090

[45] Date of Patent: Sep. 14, 1993

[54] PROTECTIVE SHEATH AND COMB ASSEMBLY FOR PAINT BRUSH

[76] Inventor: Carl L. Keith, P.O. Box 368, Sommers, Wis. 53171

[21] Appl. No.: 994,623

[22] Filed: Dec. 21, 1992

[51] Int. Cl.[5] ..... B65D 83/10

[52] U.S. Cl. ..... 206/361; 206/15.3; 15/142; 220/699

[58] Field of Search ..... 206/15.2, 15.3, 38, 206/234, 361; 15/142; 220/697, 699, 702

[56] References Cited

U.S. PATENT DOCUMENTS

| | | | |
|---|---|---|---|
| 1,000,810 | 8/1911 | Holdsworth | 220/699 |
| 1,951,576 | 3/1934 | Lehr | 206/361 |
| 3,605,160 | 9/1971 | Maurer | 15/142 |
| 4,237,579 | 12/1980 | Salmon | 15/166 |
| 4,423,811 | 1/1984 | Knapp | 206/15.3 |
| 4,802,576 | 2/1989 | Kern | 206/361 |

FOREIGN PATENT DOCUMENTS

| | | | |
|---|---|---|---|
| 511664 | 8/1939 | United Kingdom | 206/361 |

*Primary Examiner*—David T. Fidei

*Attorney, Agent, or Firm*—Wood, Phillips, VanSanten, Hoffman & Ertel

[57] ABSTRACT

A sheath and comb assembly is capable of protecting a paint brush and maintaining bristles of the paint brush in good condition. The comb can be stored within the sheath along with the paint brush. To use the comb, it is secured to the sheath so that the sheath acts as a handle. The useful condition of the bristles are maintained by combing the bristles with the comb.

15 Claims, 5 Drawing Sheets

PROTECTIVE SHEATH AND COMB ASSEMBLY FOR PAINT BRUSH

TECHNICAL FIELD

The present invention relates generally to painting and in particular relates to the protection and maintenance of the bristles of a paint brush.

BACKGROUND OF THE INVENTION

Paint is used as a decorative and protective finish on many surfaces including walls, furniture and the exterior siding of buildings. One device to apply the paint is a paint brush. The cost of a paint brush can vary depending upon the material from which the bristles are made. The paint brush purchased and used by a homeowner can have bristles made of a synthetic material and be relative inexpensive. In contrast, the paint brush of the professional painter can have bristles made of a natural material, e.g., oxtail, horsehair, or the like, which results in the paint brush being relatively expensive. Both the homeowner and the professional have a strong desire to protect their paint brushes to extend the useful life of the paint brush. Unfortunately, the bristles of the paint brush are often damaged.

When the paint brush is not in use it is often placed in a tool box or chest, on a work bench or in another environment where tools, sides of the box and other items can bend, distort or otherwise damage the bristles. When the bristles are bent or distorted it is difficult to achieve the desired finish. The bristles are often wet with a solvent such as mineral spirits or paint thinner which can ruin paint, leave stains, damage tools and cause damage to other items with which the bristles come in contact. The solvent can also end up on the brush handle which makes the handle messy to the user. If the solvent evaporates completely the dried out bristles can assume the shape which they were last in and become permanently damaged. A dry stiff paint brush must first be softened in a solvent before use which is inconvenient to the painter.

Many paint brushes are sold without a protective cover or with only a covering made of thin, sheet-form plastic or paper. Painters have attempted to protect their paint brushes by rewrapping them in the sheet-form plastic or paper or in rags. These methods of protecting the bristles do not prevent them from being bent or distorted during storage and have other shortcomings. The sheet-form plastic can deteriorate upon exposure to the solvent and ruin the paint brush. The paper or rag can become saturated with the solvent which is undesirable in maintaining the bristles in a moist condition. The solvent is readily available from the deteriorated plastic or saturated paper or rag to cause the aforementioned problems with the items with which the solvent comes in contact.

To help maintain the bristles in good condition, a comb is utilized to comb the bristles. Combing helps remove particulate matter from the bristles and separates the bristles to ensure the bristles can move independently of each other. Bristles that move independently provide a smoother paint finish. Unfortunately, the comb is not kept with the brush and the painter must search through his tools to locate the comb. The comb can be damaged, e.g., by being bent or having teeth removed, by other tools. A comb that is bent or missing teeth is less effective. Combs can be made of metal to protect them but metal combs can damage the other tools. Combs having handles to provide leverage to help remove stubborn material from the bristles take up a relatively large amount of space when one considers the number of times they are used.

Painters have a strong desire for a device to protect the bristles of their paint brushes and protect the environments in which the paint brush is stored from solvent on the bristles. Also, there is a strong desire to maintain the bristle in a moist condition for an extended period of time without contaminating the surrounding environment. Painters also desire a comb that is compact, readily available and protected from its environment. The present invention satisfies one or more of these desires.

SUMMARY OF THE INVENTION

The present invention is directed to a protective sheath and comb assembly having a sheath and comb suitable for protecting a paint brush. The paint brush has bristles, a shoulder and a handle. The assembly protects the bristles from damage that can occur when the paint brush is being stored and provides the comb to clean the bristles.

The sheath has two opposed halves with each having a base. Each base has an inner and outer surface. Sidewalls extend between the bases when the halves are placed together and the sheath is in a closed condition to define an interior cavity that is suitable to receive the bristles and the shoulder and to define an exterior space. The sidewalls define a handle opening through which the handle can extend. The handle opening is sized so that it is smaller than the shoulder to prevent the shoulder from passing through the handle opening when the halves are together.

The comb has a support and a series of teeth extending from the support. When not in use, the comb can be stored in the cavity with the paint brush. In use, the comb is secured to the sheath in the exterior space. The sheath functions as a handle of the comb to facilitate use.

It is desirable that the bristles of the used paint brush be maintained in a moist and flexible condition by the use of a solvent to prevent embrittlement of the bristles and to maintain the paint brush in condition for immediate use. A moistening material that reversibly absorbs solvent can be placed in the sheath to assist in maintaining the bristles in a moist, flexible condition. The use of the moistening material is especially advantageous when the paint brush is to be stored for an extended period of time. The moistening material can be used to retain the comb in the sheath.

The assembly enables the paint brush to be stored in a tool box or chest, on a work bench or in another environment without damage to the bristles or the comb. Furthermore, the use of the assembly can protect the environment in which the assembly containing the paint brush is stored from the solvents on the bristles and from the comb. The handle of the paint brush can also be protected from solvents on the paint brush because the handle is not encased within the sheath with the bristles and the handle opening can be sized to fit snugly against the handle to inhibit solvent leaking therethrough.

The useful life of the assembly can be longer than that of the paint brush which enables the assembly to be used with the replacement paint brush.

Numerous other advantages and features of the present invention will become readily apparent from the following detailed description of the preferred embodiments, the drawings and the appended claims.

DETAILED DESCRIPTION OF THE INVENTION

Although this invention is susceptible to embodiment in many different forms, preferred embodiments of the invention are shown. It should be understood, however, that the present disclosure is to be considered as an exemplification of the principles of this invention and is not intended to limit the invention to the embodiments illustrated.

Figure 1:
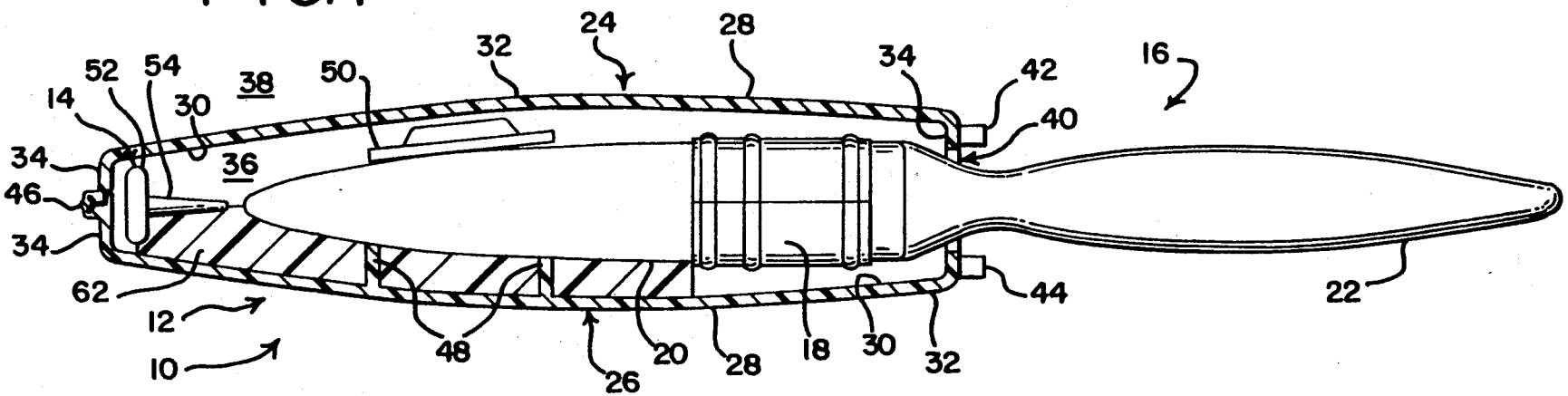
FIG. 1 is a side perspective view of the sheath and comb assembly containing a paint brush.

FIG. 1 shows the sheath and comb assembly 10 which has a sheath 12 and a comb 14. A paint brush 16 has shoulder 18 and bristles 20 within the sheath 12 and handle 22 outside of the sheath 12. The bristles 20 extend from the shoulder 18 in one direction and the handle 22 extends in another direction.

Figure 5:
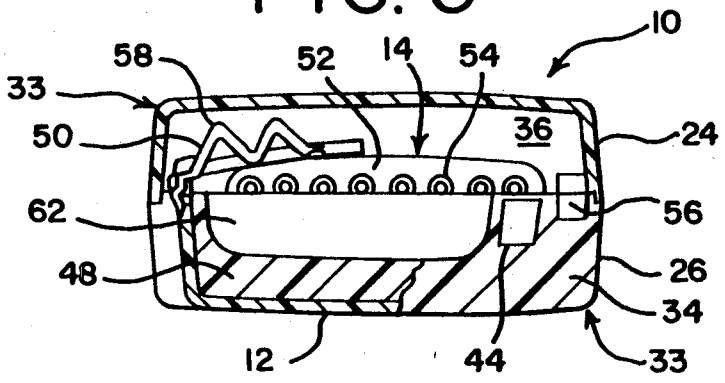
FIG. 5 is a partially broken away end view of the assembly.

The sheath 12 has first half 24 and second half 26. Bases 28 of the first half 24 and the second half 26 each have inner surface 30, outer surface 32 and perimeter 33 (FIG. 5). Sidewalls 34 extend from at least one of the bases 28, preferably from the perimeter 33, so that when the sheath 12 is in a closed condition, as illustrated in FIG. 1, the inner surfaces 28 and sidewalls 34 define an interior cavity 36, the outer surfaces 32 and the sidewalls 34 define an exterior space 38.

The sidewalls 34 define a handle opening 40 through which the handle 22 extends into the exterior space 38. The handle opening 40 is sized so that the should 18 cannot pass therethrough. Preferably, fluid communication between the interior cavity 36 and the exterior space 38 is limited to the handle opening 40, i.e., the sheath 12 seals tight except for the handle opening 40. Most preferably, when the handle 22 is within the handle opening 40 there is no fluid communication between the interior cacity 36 and the exterior space 38.

A hinge 46 is preferably utilized to permit opening and closing of the sheath 12. Alternatively, the two halves 24 and 26 can be separate. This alternative is not illustrated.

Extending from at least one of the inner surfaces 28 is at least one bristle rest 48. Clips 50 are used to retain the bristles 20 in the sheath 12 when the sheath 12 is in an open condition. The clips 50 and the bristle rest 48 can cooperate to retain the paint brush 16 in position.

The sheath 12 has first and second channels 42 and 44, respectfully, to secure the sheath and comb together when the comb 14 is to be used. The channels 42 and 44 are discussed in detail in connection with FIG. 3, below.

The comb 14 has a support 52 from which the teeth 54 extend. When not in use, the comb 14 can be held within the cavity 36 to protect the comb 14 and make it readily available for use. A moistening material 62 (only the material 62 in the second half 25 is shown, it being understood that the first half 24 would also material 62) can be used to retain the comb 14.

Figure 2:
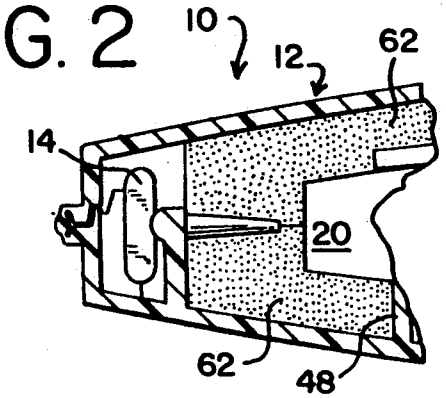
FIG. 2 is a side perspective view of the assembly illustrating an alternative for retaining the comb within the sheath.

FIG. 2 illustrates an alternative wherein the comb 14 is retained within the sheath 12 by clamp 66. Preferably, clamp 66 operates independently of the sheath 12 so that even when the sheath 12 is open, the clamp 66 still retains the comb 14 in position.

Figure 3:
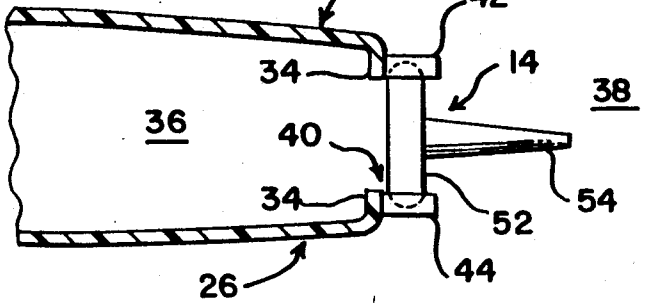
FIG. 3 is a side sectional view of a portion of the assembly with the comb positioned for use.
Figure 4:
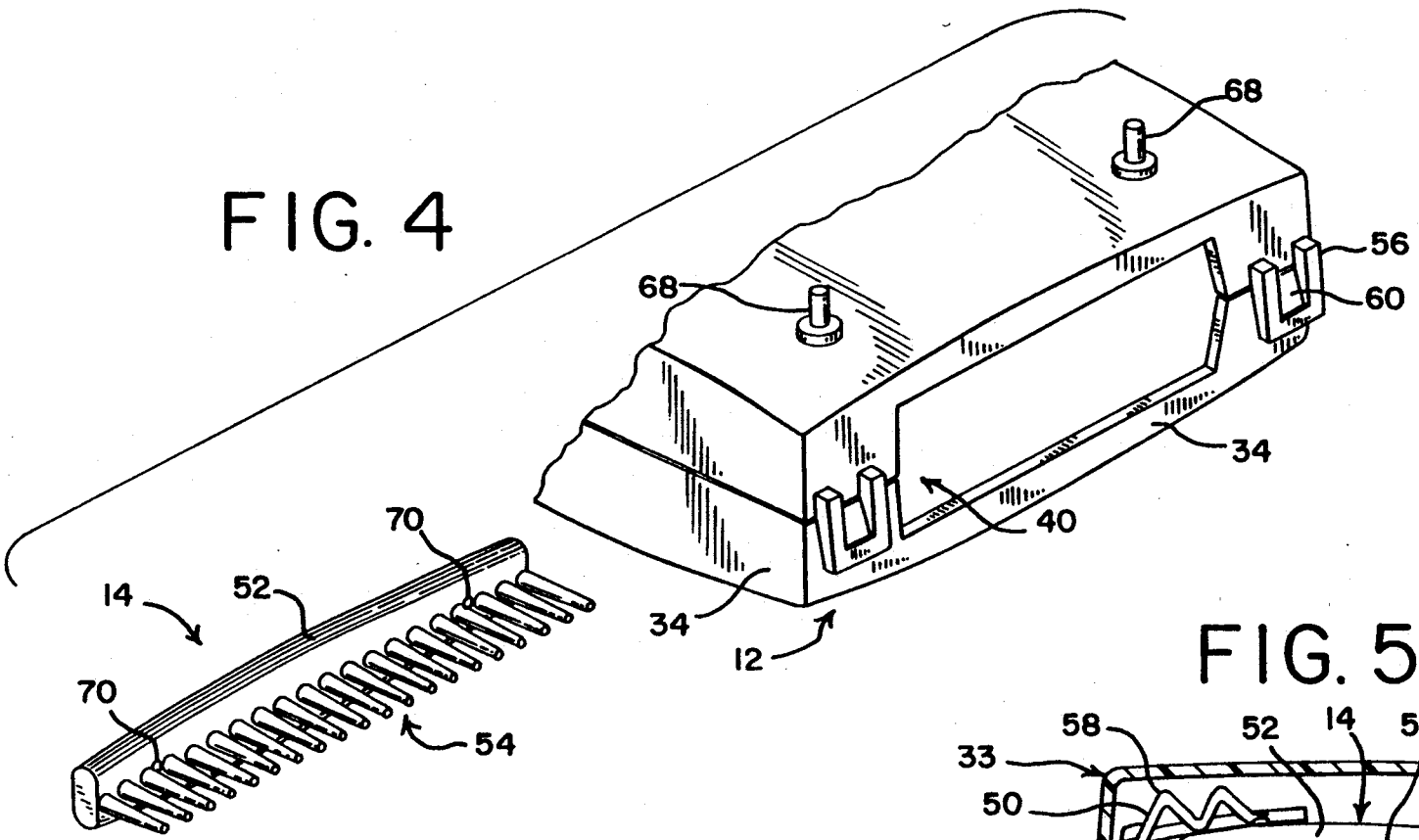
FIG. 4 is a side elevational view of a portion of the sheath illustrating an alternative for securing the comb in positioned for use.

FIG. 3 illustrates the assembly 10 configured for use of the comb 14. The support 52 is engaged on opposed sides by channels 42 and 44 that are preferably adjacent to the handle opening 40. The channels 42 and 44 secure the support 52, and hence the comb 14, and the sheath 12 together. The sheath 12 is used as a handle to facilitate the combing of a brush. By using the sheath 12 as a handle, a user's hand is distanced from the bristles and hence the paint, solvent or the like that may be on the bristles. This distancing can be desirable for many reasons including keeping the user's hand relatively clean. Preferably, the channels 42 and 44 engage the support 52 when the first half 24 and second half 26 are moved from the open condition to the closed condition. Alternatively, the channels can be configured so that the support can be slid therebetween when the sheath is in the closed condition. An additional alternative is to have the channels positioned on a long side of the sheath as opposed to an end. These alternatives are not illustrated. Yet, another alternative, which is illustrated in FIG. 4, to secure the comb 14 and sheath 12 together are mating pegs 68 and holes 70 wherein the insertion of the pegs 68 into the holes 70 effects securing.

FIG. 5 is a partially broken away end view of the assembly 10 showing the comb 14 retained in position by the moistening material 62. In order to view the comb 14, only the moistening material 62 in the second half 26 and only one of the clips are shown. The clip 50 has a living spring 58 that exerts downward pressure upon the bristles (not shown) when the clip 50 is in an engaged condition. Latch 56 is used to maintain the sheath 12 in the closed condition.

Figure 6:
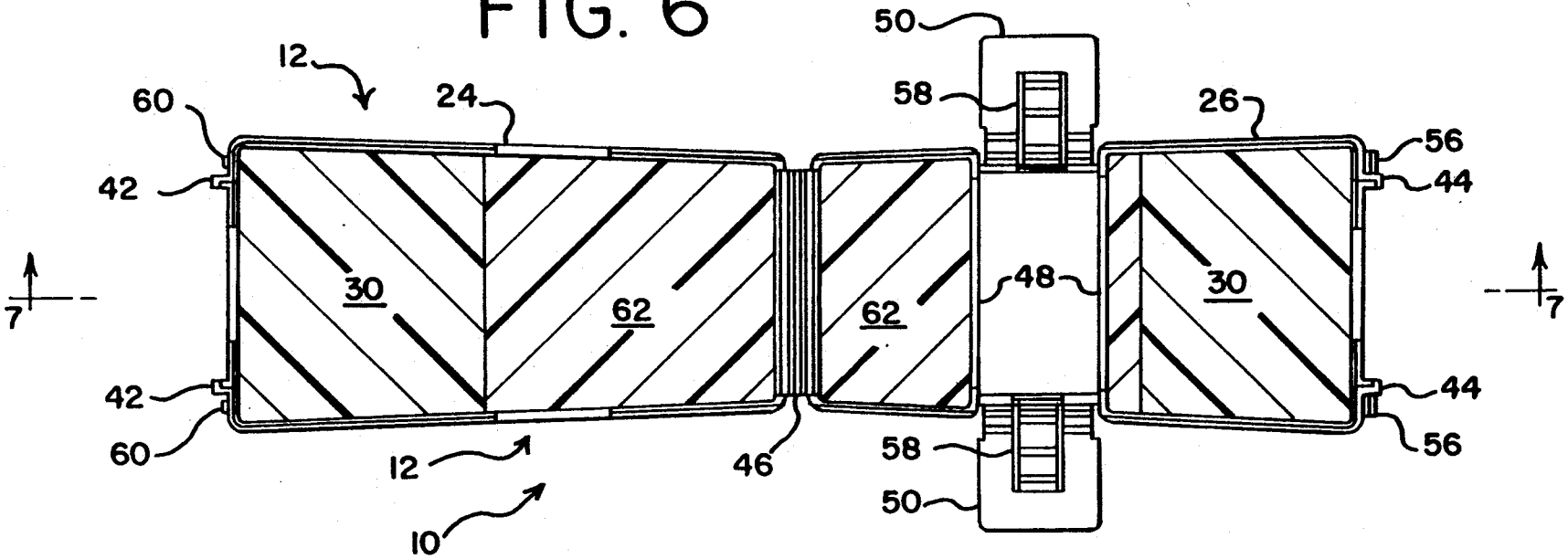
FIG. 6 is a top perspective view of the sheath.
Figure 7:
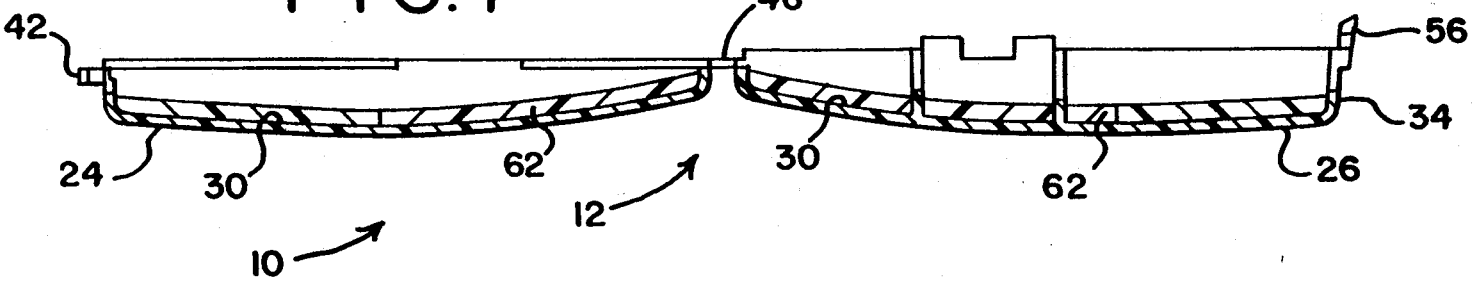
FIG. 7 is a side perspective view of the sheath taken along line 7—7 of FIG. 6.

FIGS. 6 and 7 show the sheath 12 ready to receive the comb (not shown) and brush (not shown) therein or to have the comb (not shown) inserted into one of the channels 42 and 44 so that closing of the sheath 12 retains the comb within the channels 42 and 44. Latches 54 on the second half 26 mate with tabs 60 to reversibly retain the sheath 12 in the closed condition. Alternatively, the latches and tabs can be located elsewhere. Alternatively, other devices, e.g., mating hooks and pins, interlocking hooks and loops commercially available under the tradename "velcro" and the like can be used as substitutes for the latch and tab. These alternatives are not illustrated.

FIG. 7 shows the moistening material 62 on the inner surfaces 30. The thickness of the moistening material 62 can be varied depending upon the thickness of the paint brush and the size of the interior cavity. The moistening material is preferably in contact only with the bristles.

Figure 8:
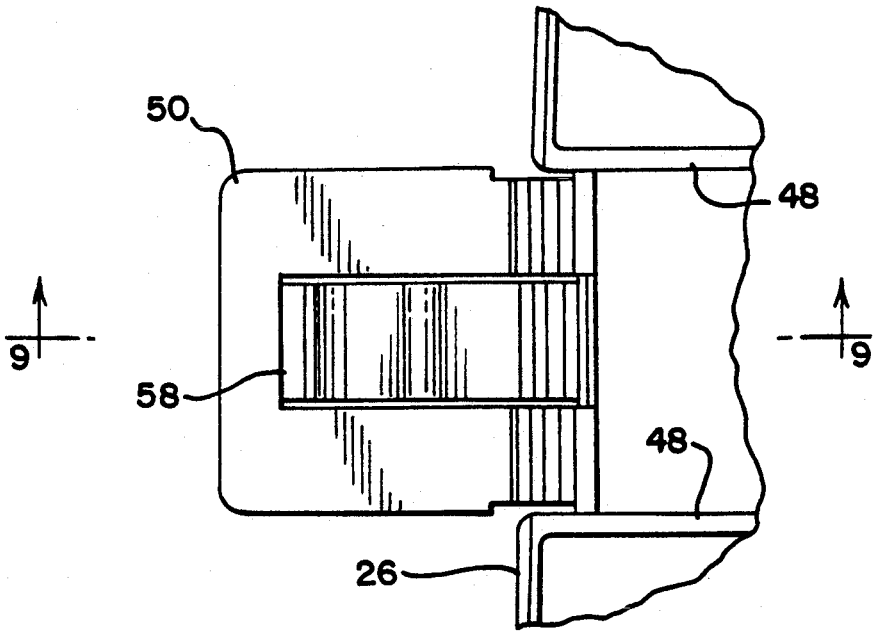
FIG. 8 is a top perspective view of the clip and bristle rests.
Figure 9:
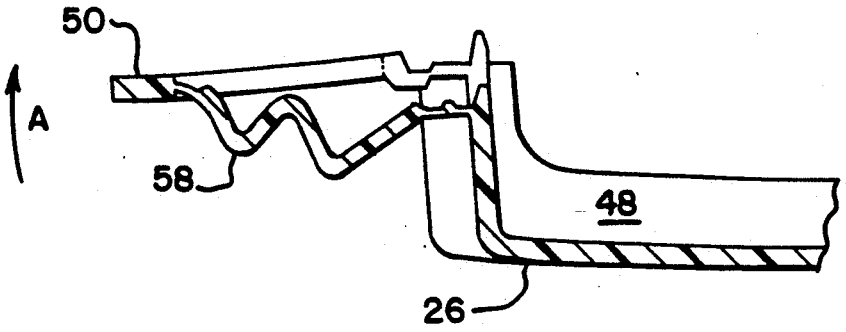
FIG. 9 is a view of the clip and bristle rests taken along line 9—9 of FIG. 8.

FIGS. 8 and 9 show the clip 50. To close the clip 50, it is rotated upward in the direction indicated by arrow "A." During pivoting, the living spring 58 is stretched with the maximum stretch being at a about 90° to the position of the clip 50 illustrated in FIG. 9. As pivoting continues past the 90° point, the living spring 58 relaxes and forces the clip 50 downward to either engage the bristles (not shown) or permit the sheath to be closed.

Figure 10:
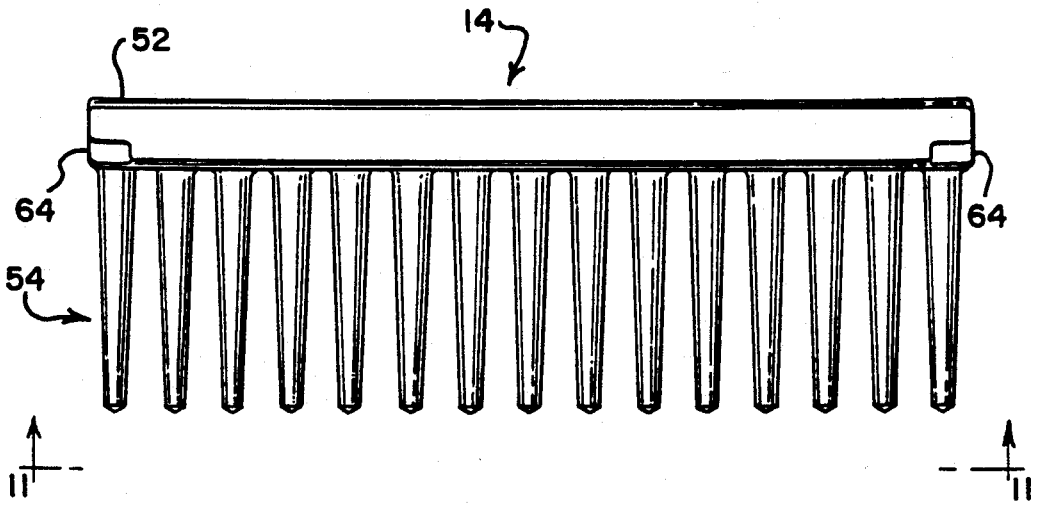
FIG. 10 is a side perspective view of the comb.
Figure 11:
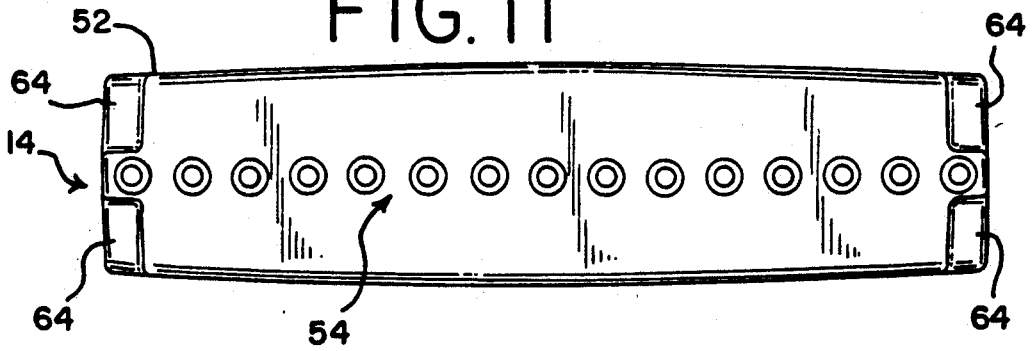
FIG. 11 is a view of the comb taken along line 11—11 of FIG. 10.

FIGS. 10 and 11 illustrate the comb 14 in a preferred embodiment. The support 52 has recesses 64 therein that are engaged by the channels.

The assembly can be made of any material that is resistent to the solvents which the bristles may contain and should provide the desired protection of the bristles. Suitable materials for the manufacturing of the assembly include thermoplast materials, e.g., polystyrenes, polyethylene, polypropylene and the like, thermoset materials, e.g., epoxy, acrylic and the like resin systems, and like materials that can be economically made into sheaths.

The moistener material can contain absorbed solvent prior to placing the bristles in contact with, or adjacent to, the moistener. Alternatively, the moistener material can be dry and be used to absorb solvent that is on the bristles when the paint brush is first placed in the sheath. The absorbed solvent is available to moisten the bristles as needed. The use of the moistener material is particularly advantageous when that contact with the bristles is maintained. The moistener material is made of a reversibly absorbent material that does not degrade upon exposure to the solvents. Suitable materials include foams, cloths, and the like.

This invention has been described in terms of specific embodiments set forth in detail, but it should be understood that these are by way of illustration only and that the invention is not necessarily limited thereto. Modifications and variations will be apparent from this disclosure and may be resorted to without departing from the spirit of this invention, as those skilled in the art will readily understand. Accordingly, such variations and modifications of the disclosed products are considered to be within the purview and scope of this invention and the following claims.

I claim:

1. A protective sheath and comb assembly for a paint brush having bristles, a shoulder and a handle, the bristles extend from one end of the shoulder and the handle extends from another end of the shoulder, the assembly being suitable for protecting and maintaining bristles, the assembly comprising:

(a) a comb having a support and a series of teeth extending from the support:

(b) a sheath comprising:

opposed first and second halves, each half comprising a base having an inner surface and an outer surface;

means for reversibly securing the halves together in a closed condition; and sidewalls extending between the bases of the halves when the sheath is in a closed condition to define, with the inner surfaces, an interior cavity and to define, with the outer surfaces, an exterior space, the sidewalls defining a handle opening therein sized to permit the handle to extend therethrough to the exclusion of the shoulder, the cavity being suitable to receive the bristles and the shoulder, the handle opening being suitable to permit the handle to extend into the exterior space; and (c) means for securing the support and sheath together with the teeth being located in the exterior space.

2. The sheath and comb assembly in accordance with claim 1 wherein the securing means are engaged by closing the sheath.

3. The sheath and comb assembly in accordance with claim 1 wherein the securing means comprises channels capable of securing the support therein.

4. The sheath and comb assembly in accordance with claim 3 wherein the channels are on opposed sidewalls and secure the support and sheath together when the sheath is in the closed condition.

5. The sheath and comb assembly in accordance with claim 3 wherein the channels are adjacent to the handle opening.

6. The sheath and comb assembly in accordance with claim 1 further comprising means for retaining the comb within the cavity.

7. The sheath and comb assembly in accordance with claim 6 wherein the retaining means is also a means within the cavity for moistening the bristles.

8. The sheath and comb assembly in accordance with claim 1 wherein the sidewalls extend from each of the bases.

9. A protective sheath and comb assembly for use with a paint brush having bristles, a shoulder and a handle, the bristles extend from one end of the shoulder and the handle extends from another end of the shoulder, the assembly being capable of protecting and maintaining the bristles in useable condition, the assembly comprising:

(a) a comb comprising a support and teeth extending from the support;

(b) a sheath comprising:

opposed first and second halves, each half comprising a base having a perimeter, an inner surface, an outer surface and sidewalls extending from the inner surface next to the perimeter;

means for reversibly securing the halves together, when the halves are together the inner surfaces and sidewalls define an interior cavity therebetween, the outer surfaces and sidewalls define an exterior space and the sidewalls define a handle opening, the cavity being suitable to receive the bristles and the shoulder and the handle opening being suitable to permit the handle to extend therethrough and into the exterior space and keep the shoulder within the cavity, the cavity being in fluid communication with the exterior space substantially only through the handle opening; and (c) means for securing the support and sheath together so the teeth extend into the exterior space, the securing means being located on opposed sidewalls.

10. The sheath and comb assembly in accordance with claim 9 wherein the securing means are engaged by closing the sheath.

11. The sheath and comb assembly in accordance with claim 9 wherein the securing means comprises channels capable of securing the support therein.

12. The sheath and comb assembly in accordance with claim 11 wherein the channels are on opposed sidewalls and secure the support and sheath together when the sheath is in the closed condition.

13. The sheath and comb assembly in accordance with claim 11 wherein the channels are adjacent to the handle opening.

14. The sheath and comb assembly in accordance with claim 9 further comprising means for retaining the comb within the cavity.

15. The sheath and comb assembly in accordance with claim 14 wherein the retaining means is also a means within the cavity for moistening the bristles.

* * * * *